US006280247B1

(12) United States Patent
Wu et al.

(10) Patent No.: US 6,280,247 B1
(45) Date of Patent: Aug. 28, 2001

(54) SURFACE MOUNTED ELECTRICAL CONNECTOR

(75) Inventors: Jerry Wu, Chang-Hua; Chi Sheng Wang, Tu-Chen, both of (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/515,417

(22) Filed: Feb. 29, 2000

(30) Foreign Application Priority Data

Nov. 23, 1999 (TW) ..... 88219928 U

(51) Int. Cl.[7] ..... H01R 13/73
(52) U.S. Cl. ..... 439/570
(58) Field of Search ..... 439/570, 567, 439/571, 572

(56) References Cited

U.S. PATENT DOCUMENTS 5,232,379 * 8/1993 Lai ..... 439/570
6,012,949 * 1/2000 Lok ..... 439/570
6,022,244 * 2/2000 Chiu ..... 439/570
6,053,763 * 4/2000 Brennan et al. ..... 439/570
6,053,767 * 4/2000 Copper et al. ..... 439/570

* cited by examiner

*Primary Examiner*—Gary F. Paumen
(74) *Attorney, Agent, or Firm*—Wei Te Chung

(57) ABSTRACT

Two solder pads both having a horizontal solder tab therein and a vertical positioning leg used to mount a surface mounted electrical connector to a printed circuit board. The electrical connector comprises an elongated insulative housing having a holding cavity at each side thereof. Each of a plurality of terminals secured in the plurality of receiving channels of the insulative housing includes an engaging portion and a solder tail. Each solder pad includes an L-shaped body and a positioning leg downwardly extending from the L-shaped body. The L-shaped body comprises a vertical body portion and a horizontal solder tab for respectively engaging with the holding cavity of the insulative housing and being soldered to the printed circuit board. The positioning leg extends through a hole of the printed circuit board, where it, too, is soldered, thus adding strength to the board between the connector and the printed circuit board.

1 Claim, 4 Drawing Sheets

SURFACE MOUNTED ELECTRICAL CONNECTOR

BACKGROUND OF THE INVENTION

The present invention relates to an electrical connector, and particularly to an electrical connector with an improved solder pad which is capable of securing the connector against the surface of a printed circuit board with greater strength using a soldering process.

Prior art U.S. Pat. Nos. 4,713,013 and 4,850,892; 5,044,988 disclose electrical connectors having posts integrally extending from the bottom surface of the insulative housing. However, these integral posts have insufficient resilient characteristics. Recent patents, such as U.S. Pat. Nos. 4,681,389 and 4,907,987 each disclose using separate resilient metallic posts associated with the housing to retain the connector assembly on the printed circuit board.

Referring to FIG. 4, U.S. Pat. No 5,232,379 discloses an electrical connector with mounting means to secure on a printed circuit board. This connector comprises an elongated insulative housing having embedded therein and extending therethrough a plurality of terminals, the tails of which are bent to be parallel with the printed circuit board. A mounting means has an L-shaped body. One leg of the body being coplanar with a bottom surface of the housing is positioned at each end of the housing. The mounting means further comprises a U-shaped body perpendicular to the L-shaped body, a portion of which is received within a slot in the insulative housing and has a projecting tab abutting against the inner portion of the slot to fasten the mounting means to the insulative housing. A disadvantage of this connector is that the securing relationship between the mounting means and the printed circuit board is insufficient to endure a large lateral force because the mounting means itself for securing to the board.

Hence, an improved electrical connector is required to overcome the disadvantages of the prior art.

BRIEF SUMMARY OF THE INVENTION

An object of the present invention is to provide an improved solder pad for surface mounting an electrical connector which is capable of securing the connector against the surface of a printed circuit board with greater strength using a soldering process.

To fulfill the above-mentioned objective, an electrical connector in accordance with the present invention has a pair of solder pads for mounting the electrical connector to a printed circuit board. The electrical connector comprises an elongated insulative housing having a plurality of receiving channels extending between a front face and a rear face thereof. A plurality of terminals is secured in corresponding receiving channels. A holding cavity is formed at each side of the insulative housing. Each of the pair of solder pads includes a L-shaped body and a positioning leg extending from a lateral edge of the L-shaped body. The L-shaped body comprises a vertical body portion and a horizontal solder tab for respectively engaging with the holding cavity of the insulative housing and being soldered to the printed circuit board. The positioning leg extends through a hole on the printed circuit board, where it, too, is soldered, thus adding strength to the printed circuit board between the connector and the board.

Other objects, advantages and novel features of the invention will become more apparent from the following detailed description of the present embodiment when taken in conjunction with the accompanying drawings.

DETAILED DESCRIPTION OF THE INVENTION

Figure 1:
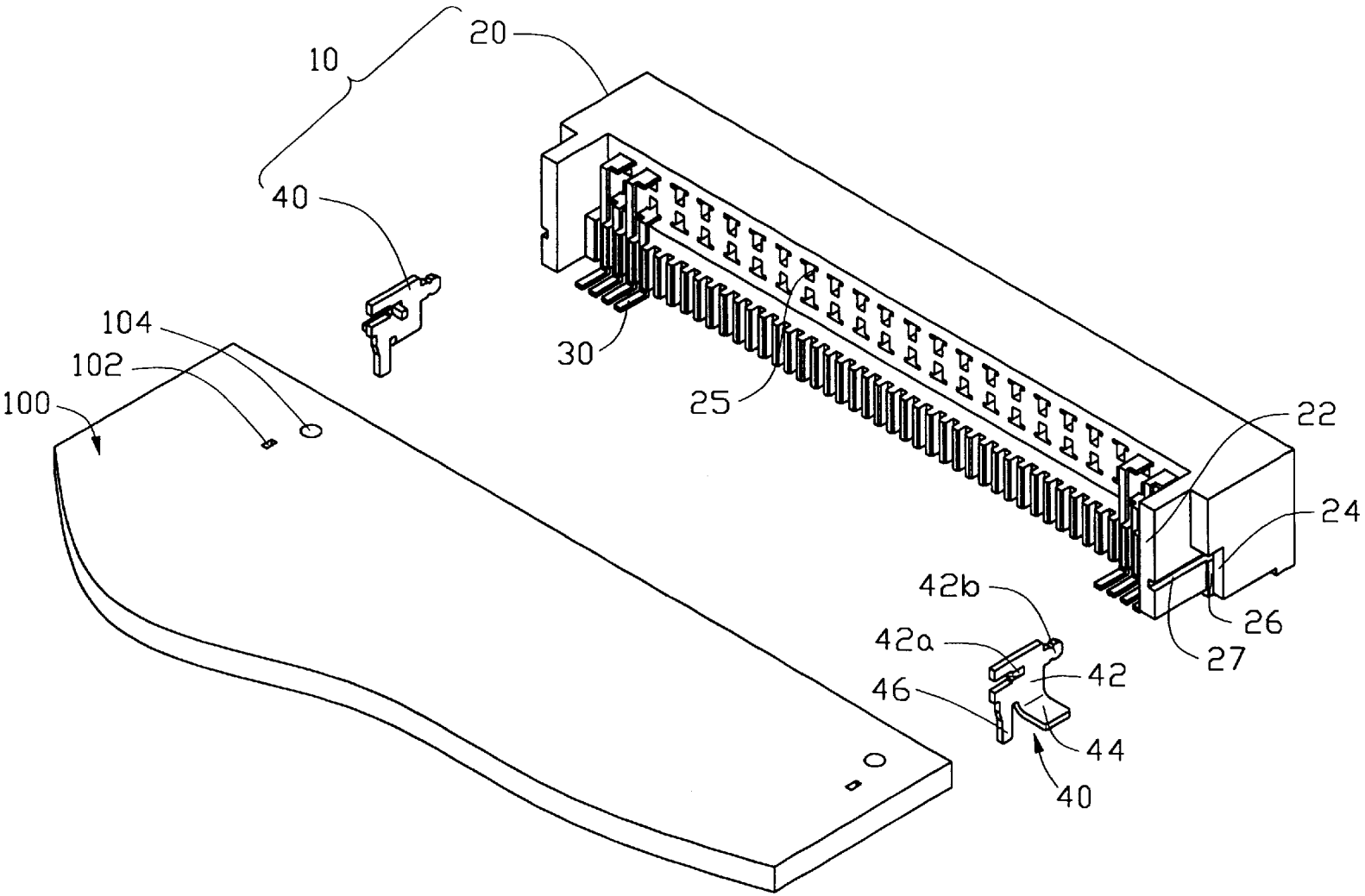
FIG. 1 is an exploded view of an electrical connector in accordance with the present invention.
Figure 2:
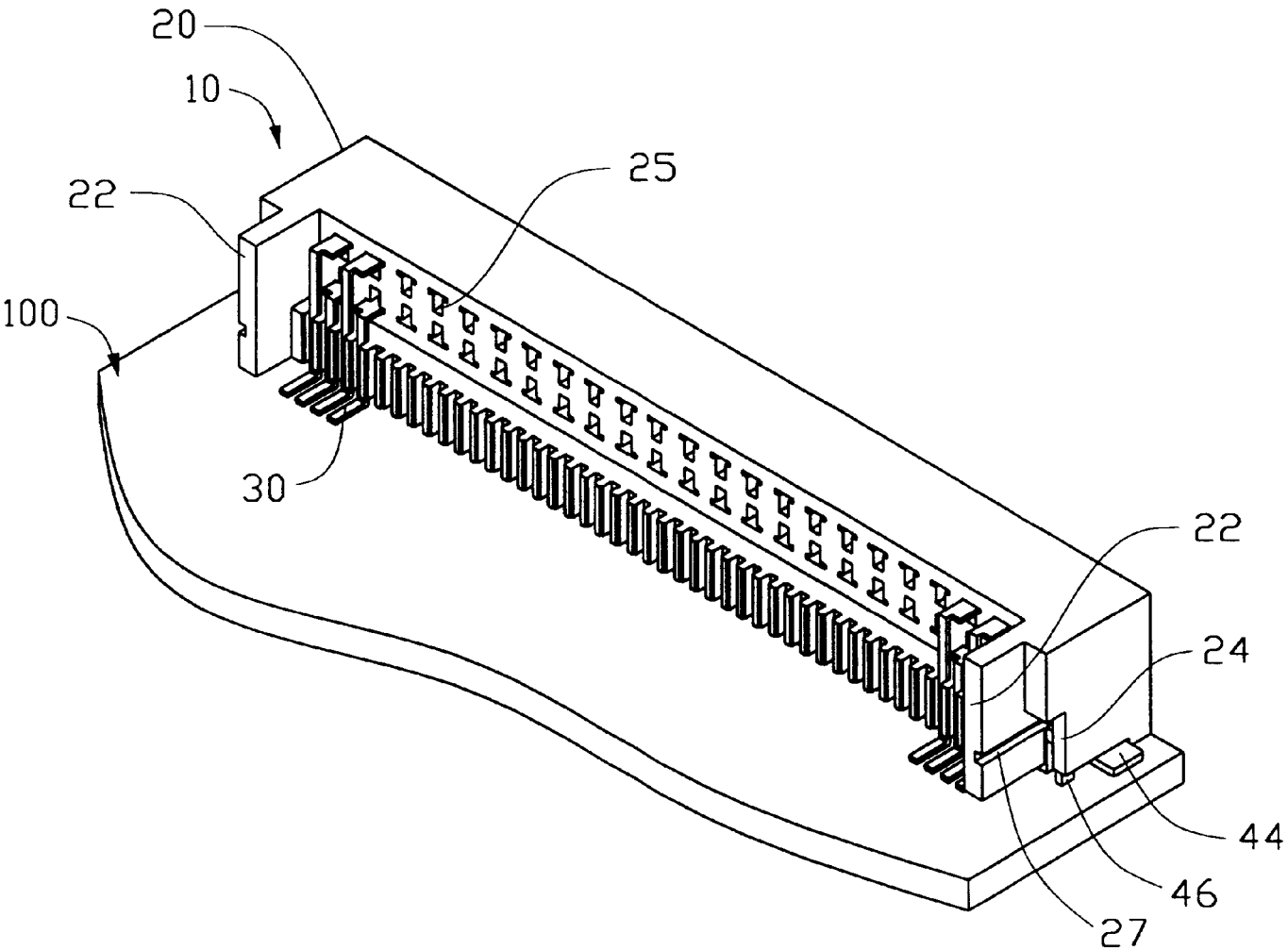
FIG. 2 is an assembled view of the connector of FIG. 1.

Referring to FIGS. 1 and 2, an electrical connector 10 in accordance with the present invention comprises an elongated insulative housing 20, a plurality of terminals 30 secured in the insulative housing 20, and a pair of solder pads 40 inserted into two lateral ends of the insulative housing 20 for securing the insulative housing 20 to a printed circuit board 100.

Figure 3:
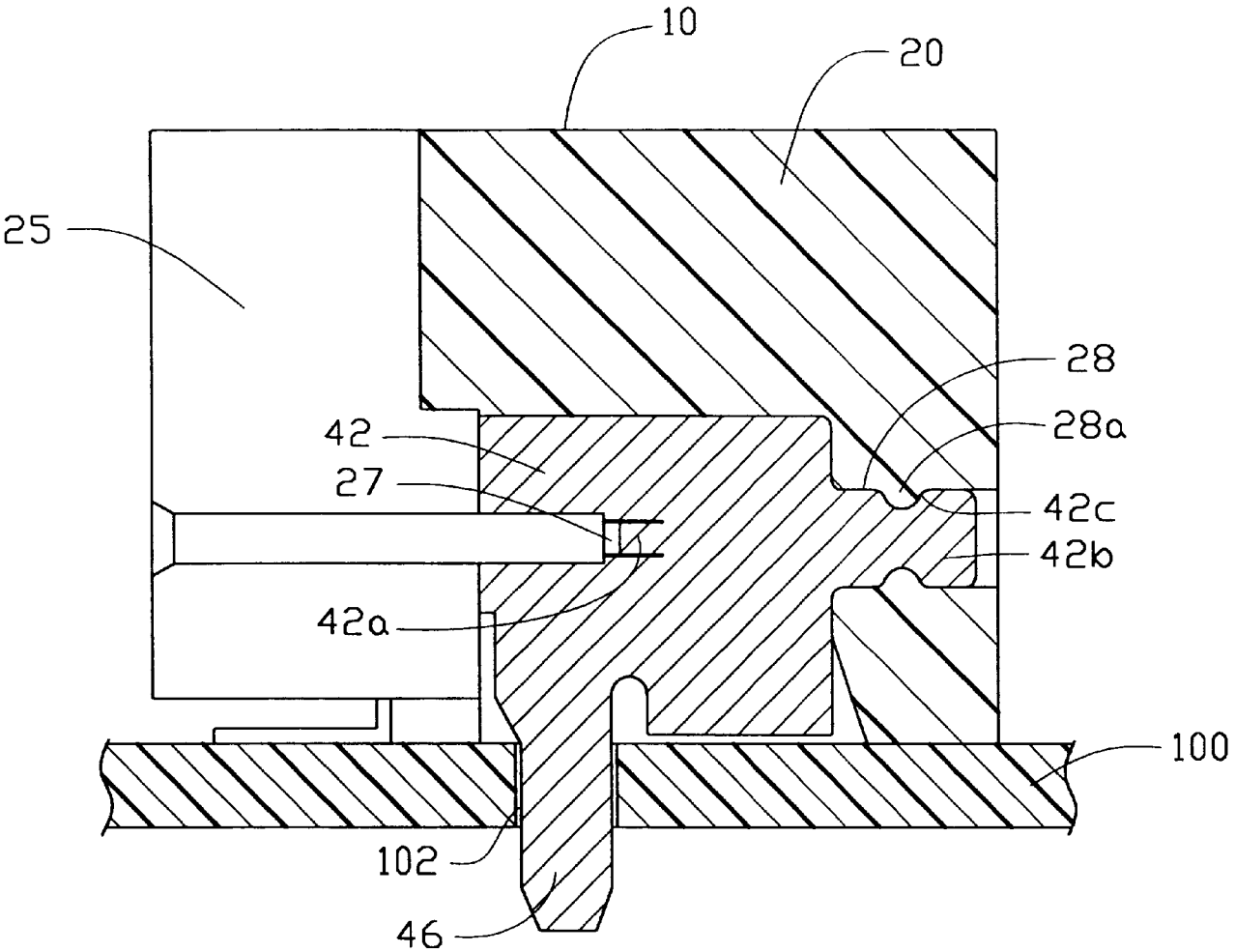
FIG. 3 is a cross-sectional view of the electrical connector in accordance with the present invention including a cross-section of the solder pad.
Figure 4:
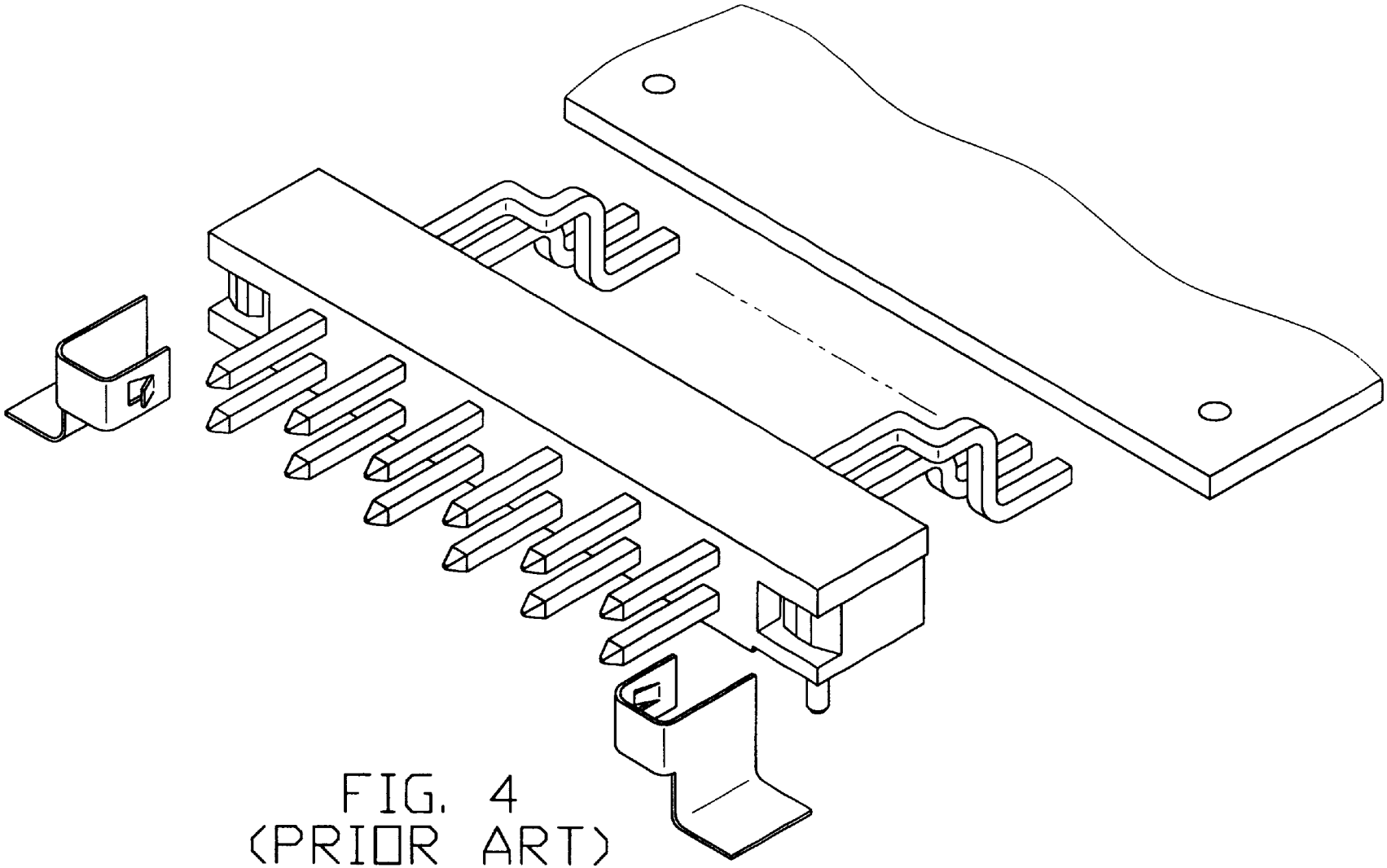
FIG. 4 (PRIOR ART)
FIG. 4 is an exploded view of a prior art electrical connector.

Also referring to FIG. 3, the insulative housing 20 comprises a plurality of receiving channels 25 defined through a front face and a rear face (not labeled) thereof. The insulative housing 20 further includes a pair of first flanges 22 and a pair of second flanges 24 both protruding rearwards from the rear face and located about two lateral ends of the housing 20. Each first flange 22 is laddered reward respect to a corresponding second flange 24. The second flange 24 defines a holding cavity 26 extending outward from the rear face to the front face of the insulative housing 20. The first flange 22 defines an elongated slot 27 recessed into one side of the outward face (not labeled) of the insulative housing 20 and in communicating with the holding cavity 26. The holding cavity 26 further extends a securing channel 28 in communicating with the front face thereof. The insulative housing 20 further protrudes two opposite ridges 28*a* on an upper and a lower side of the securing channel 28. A pair of posts 29 is integrally formed with the insulative housing 20 and extends from a bottom surface (not labeled) thereof for positioning the electrical connector 10 to the printed circuit board 100 during the soldering process.

The plurality of terminals 30 are secured within corresponding receiving channels 25 of the insulative housing 20. Each terminal 30 includes an engaging portion (not labeled) for securing within the corresponding receiving channel 25, and a solder tail (not labeled) for soldering to the printed circuit board 100.

Each solder pad 40 includes an L-shaped body and a positioning leg 46. The L-shaped body has a vertical body portion 42 for securing within the holding cavity 26 and a horizontal solder tab 44 connecting with the body portion 42. Each body portion 42 includes an interfering portion 42*a* perpendicularly extending from one side face thereof for interferrentially engaging within the slot 27 of the insulative housing 20. A securing portion 42*b* extends rearward from a rearward edge of each body portion 42 for securely engaging with corresponding securing channel 28. Each securing portion 42*b* further defines a pair of recesses 42*c* on an upper and lower edge thereof for securely engaging with the ridges 28*a* of the insulative housing 20. The positioning legs 46 extends vertically downward from the forward bottom edge of the body portion 42 and is adapted to extend through one of a pair of first holes 102 defined through the printed circuit board 100. Referring to FIG. 1 to FIG. 3, the printed circuit board 100 additionally defines a pair of second holes 104 for accepting and retaining the posts 29.

In assembly, the plurality of terminals 30 is first assembled into the plurality of receiving channels 25. The pair of solder pads 40 is inserted into corresponding holding cavities 26 of the insulative housing 20. The body portion 42 of each solder pad 40 is retained within each holding cavity 26. Each interfering portion 42*a* is then engaged with the corresponding slot 27, and each securing portion 42*b* interferentially fit within the corresponding securing channel 28, the recesses 42*c* securely engage with the ridges 28*a*, thereby firmly retaining the solder pads 40 within the insulative housing 20. The electrical connector 10 is then assembled to the printed circuit board 100 with the positioning legs 46 of the solder pad 40 and the posts 29 of the housing 20 respectively inserted through the first holes 102 and the second holes 104. The solder tails 34 of the terminals 30, the solder tabs 44 and positioning leg 46 of the solder pads 40 are then soldered to the printed circuit board 100.

An advantage of the present invention is that the positioning legs 46 can firmly position the solder pads 40 to the printed circuit board 100 during the soldering process thereby avoiding damage due to application of an external force on the solder pads 40 during soldering process. Additionally, the positioning legs 46 further increase the holding strength of the solder pads 40 between the electrical connector 10 and the printed circuit board 100.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A surface mounted electrical connector for mounting to a printed circuit board, comprising:

an elongated insulative housing having a holding cavity and a slot at a side thereof;

a plurality of terminals secured in the insulative housing; and a solder pad including an L-shaped body and a positioning leg extending from the L-shaped body, the L-shaped body having a vertical body portion for securely engaging in the holding cavity of the insulative housing and a horizontal solder tab extending from an lower edge of the vertical body portion for being soldered to the surface of the printed circuit board, the positioning leg extending through a hole of the printed circuit board;

wherein the holding cavity is in communication with the slot, and the L-shaped body includes an interfering portion projecting from a side face of the vertical body portion of the L-shaped body for securely engaging within the slot;

wherein the insulative housing includes a securing channel connecting with the holding cavity, and the L-shaped body includes a securing portion integrally extending from the vertical body portion for being retained in and engaging with the securing channel;

wherein the securing channel of the insulative housing further has two opposite ridges on upper and lower sides thereof protruding into the securing channel, and the securing portion further includes a pair of recesses corresponding to the ridges for securely engaging with these ridges.

* * * * *